US006883864B2

(12) United States Patent
Gregory

(10) Patent No.: US 6,883,864 B2
(45) Date of Patent: Apr. 26, 2005

(54) PORTABLE PICNIC TABLE

(75) Inventor: Michael A. Gregory, Wooster, OH (US)

(73) Assignee: Rubbermaid, Inc., Wooster, OH (US)

( * ) Notice: Subject to any disclaimer, the term of this patent is extended or adjusted under 35 U.S.C. 154(b) by 0 days.

(21) Appl. No.: 10/639,332

(22) Filed: Aug. 12, 2003

(65) Prior Publication Data

US 2004/0070235 A1 Apr. 15, 2004

Related U.S. Application Data

(60) Provisional application No. 60/402,756, filed on Aug. 12, 2002.

(51) Int. Cl.[7] ..... A47B 83/02

(52) U.S. Cl. ..... 297/158.5; 297/158.4

(58) Field of Search ..... 297/157.1, 158.3, 297/158.4, 158.5; 108/180, 181, 186, 187, 101, 162, 169, 179, 17

(56) References Cited

U.S. PATENT DOCUMENTS

| | | | | |
|---|---|---|---|---|
| 1,585,598 A | | 5/1926 | Miner | |
| 2,452,169 A | | 10/1948 | Wells | |
| 2,689,158 A | | 9/1954 | Mahr | |
| 2,690,210 A | | 9/1954 | Holick | |
| 2,722,971 A | * | 11/1955 | Gallagher et al. | 297/158.5 |
| 2,746,525 A | * | 5/1956 | Cooper | 297/158.5 |
| 2,756,082 A | | 7/1956 | Pucci | |
| 2,766,812 A | | 10/1956 | Schrader | |
| 2,825,390 A | * | 3/1958 | Post | 297/139 |
| 2,939,516 A | | 6/1960 | Drew | |
| 3,025,120 A | | 3/1962 | Howe | |
| 3,091,732 A | | 5/1963 | Anderson et al. | |
| 3,273,936 A | | 9/1966 | Deavers | |
| 3,357,729 A | | 12/1967 | Krueger | |
| 3,574,393 A | | 4/1971 | Hughes | 297/157 |
| 3,637,045 A | | 1/1972 | Poffenbaugh et al. | |
| 4,191,111 A | | 3/1980 | Emmert | |
| 4,330,151 A | | 5/1982 | Healey | |
| 4,502,686 A | | 3/1985 | Iiams, Jr. | |
| 4,607,880 A | * | 8/1986 | Gastebled | 297/158.5 |
| 4,727,816 A | | 3/1988 | Virtue | |
| 4,744,309 A | | 5/1988 | Kiesel et al. | |
| 4,841,877 A | | 6/1989 | Virtue | |

(Continued)

FOREIGN PATENT DOCUMENTS

| | | |
|---|---|---|
| CA | 2166651 A1 | 7/1996 |
| CH | 335 819 A | 1/1959 |
| DE | 341007 | 5/1920 |
| FR | 2 553 644 A1 | 4/1985 |
| GB | 10007 | 12/1908 |
| GB | 2 063 755 A1 | 6/1981 |
| JP | 09065934 | 3/1997 |
| JP | 10075825 | 3/1998 |
| WO | WO 97/15212 | 5/1997 |
| WO | WO 99/02068 | 1/1999 |

OTHER PUBLICATIONS

PCT International Search Report issued in PCT/US03/25126, Mar. 18, 2004.
Written Opinion for International Application No. PCT/US03/25126 mailed Jul. 16, 2004.
English translation of Swiss Patent No. 335 819 A.

*Primary Examiner*—Peter R. Brown
(74) *Attorney, Agent, or Firm*—Marshall, Gerstein & Borun LLP

(57) ABSTRACT

A portable picnic table is disclosed. The picnic table can be configured from a setup configuration to a portable configuration by detachment of the benches from the table, folding the bench supports and the table supports, and attaching the benches to the table, while both are in the folded configuration. Alternately, the benches can remain attached to the table, and the picnic table can be configured from a setup configuration to a portable configuration by simultaneously folding the bench supports and table supports so that the benches and the table lie in one plane.

17 Claims, 12 Drawing Sheets

U.S. PATENT DOCUMENTS

| | | | | |
|---|---|---|---|---|
| 5,029,861 | A | 7/1991 | Driska | |
| 5,279,233 | A | 1/1994 | Cox | |
| 5,390,999 | A | 2/1995 | Fuller | |
| 5,443,020 | A | 8/1995 | Price | |
| 5,536,552 | A | 7/1996 | Scripsick | |
| 5,623,882 | A | 4/1997 | Price | |
| 5,678,491 | A | 10/1997 | Price et al. | |
| 5,803,536 | A | 9/1998 | Perzee et al. | 297/158.5 |
| 5,921,623 | A | 7/1999 | Nye et al. | |
| D414,626 | S | 10/1999 | Collins et al. | |
| 5,992,331 | A | 11/1999 | Inoue et al. | |
| D419,332 | S | 1/2000 | Collins et al. | |
| 6,032,585 | A | 3/2000 | Pinch | |
| 6,058,853 | A | 5/2000 | Pinch | |
| 6,086,148 | A | 7/2000 | Gatto et al. | |
| 6,109,687 | A | 8/2000 | Nye et al. | |
| 6,112,674 | A | 9/2000 | Stanford | |
| 6,347,831 | B1 | 2/2002 | Nye et al. | |
| 6,431,092 | B1 | 8/2002 | Stanford | |
| D468,135 | S | 1/2003 | Ashby et al. | |
| 6,508,184 | B1 | 1/2003 | Winter et al. | |
| 6,644,734 | B1 | 11/2003 | Tseng | 297/158.4 |

* cited by examiner

PORTABLE PICNIC TABLE

RELATED APPLICATIONS

This application claims the benefit of U.S. Provisional Application No. 60/402,756, filed Aug. 12, 2002.

FIELD OF INVENTION

The present disclosure generally relates to picnic tables and, more particularly, to a portable picnic table.

BACKGROUND

Picnic tables are generally used outdoors and can be found at playgrounds, parks, campsites, and even backyards. It is becoming more common to find picnic tables in backyards and on decks of private dwellings. Picnic tables typically have a center table with two benches disposed on two opposed sides of the table. Although picnic tables serve the function of providing seating for outdoor activities quite well, certain aspects of typical picnic tables prevent their more widespread use. For instance, because the benches are typically attached to the table by a support structure, such picnic tables are not readily portable. Furthermore, the traditional solid wood construction of picnic tables results in a heavy picnic table that requires more than one person to move the table to another location.

DESCRIPTION OF THE PREFERRED EMBODIMENTS

Figure 1:
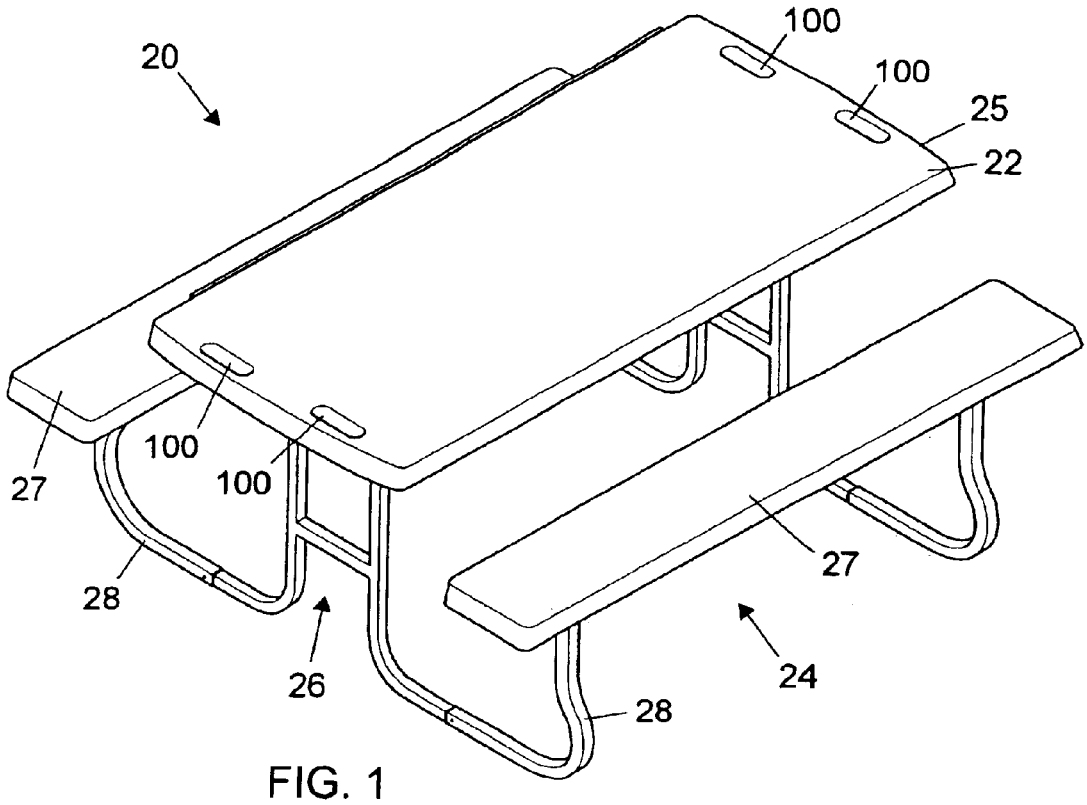
FIG. 1 is a perspective view of a picnic table in accordance with the teachings of a first example of the instant invention, and shown in a setup configuration.
Figure 2:
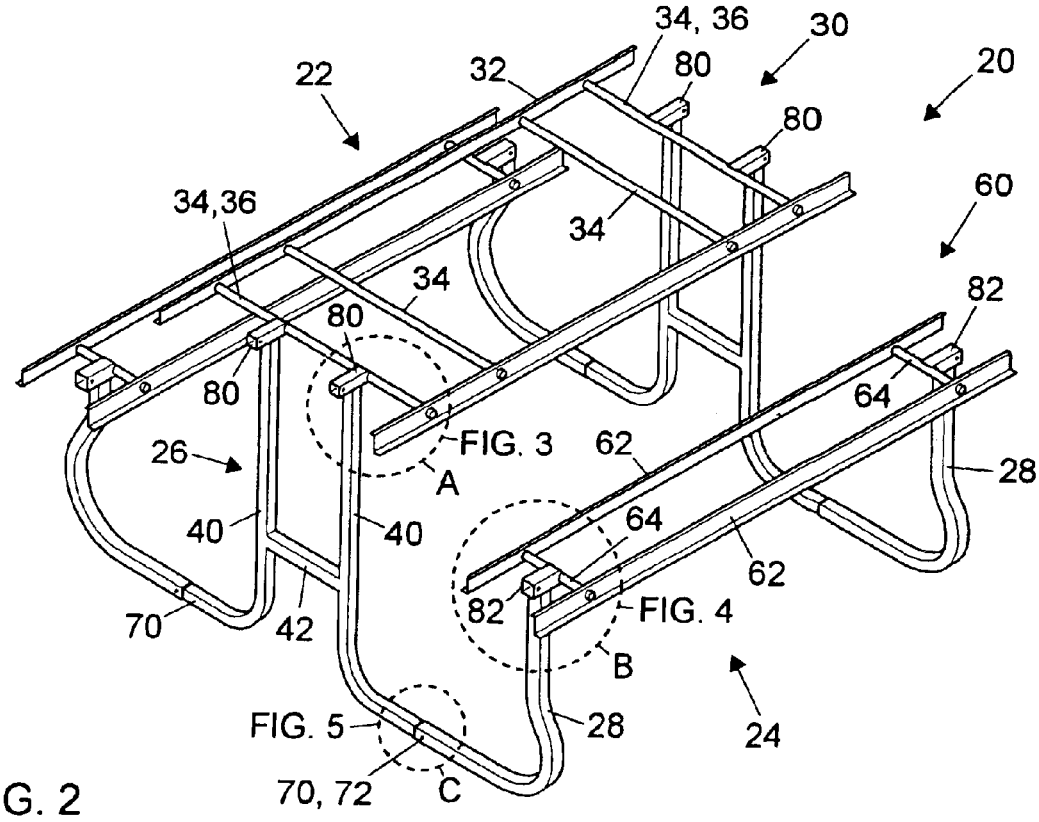
FIG. 2 is a perspective view of the undercarriage of the picnic table of FIG. 1.
Figure 3:
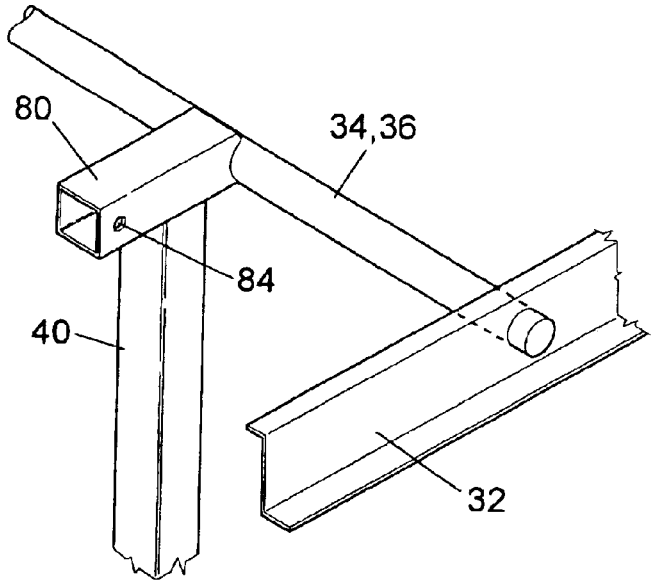
FIG. 3 is an enlarged view of area A of FIG. 2.
Figure 4:
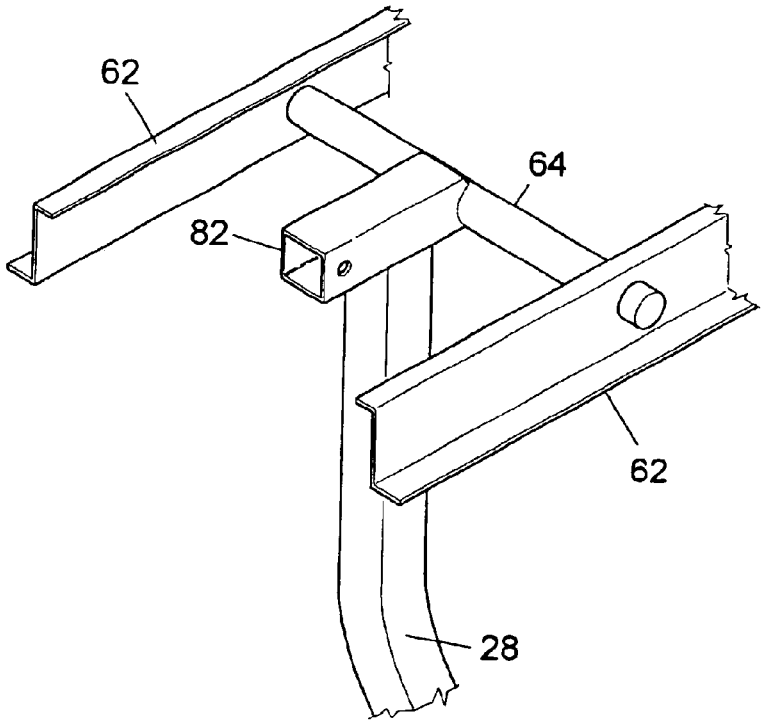
FIG. 4 is an enlarged view of area B of FIG. 2.
Figure 5:
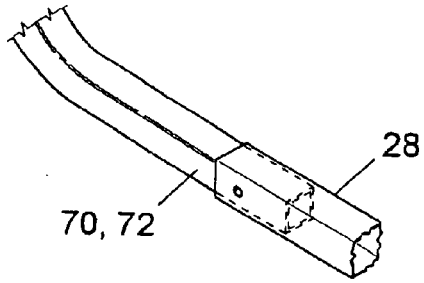
FIG. 5 is an enlarged view of area C of FIG. 2.

A number of examples of picnic tables are disclosed and described herein in accordance with the teachings of the invention. In the first example, the picnic table can be configured from a setup configuration to a portable configuration by detachment of the benches from the table, folding the bench supports and the table supports, and attaching the benches to the table, while both are in the folded configuration. In the second example, the benches remain attached to the table, and the picnic table can be configured from a setup configuration to a portable configuration by simultaneously folding the bench supports and table supports so that the benches and the table lie in one plane.

Referring to FIGS. 1–13, the first example of the picnic table 20 constructed in accordance with the teachings of the invention is shown. The picnic table 20 includes a table 22 and a pair of benches 24. The table 22 includes a table top 25 and a pair of table supports 26 that are pivotally attached beneath the table 22. One of ordinary skill in the art will readily appreciate that the table supports 26 can be pivotally attached to the table top 25 by a wide variety of methods. For instance, each table support 26 can be pivotally and directly attached to the table top 25 with a hinge that provides pivotal movement of the table support 26 beneath the table top 25. However, in the disclosed examples, the table 22 includes a table frame 30, to which the table top 25 is attached and the table supports 26 are pivotally attached. The table frame 30 includes two spaced apart and generally parallel table frame rails 32 connected together by a number of transversely oriented table cross bars 34.

One of ordinary skill in the art will appreciate that the use of the words "rails" and "bars" to describe the table frame rails 32 and the table cross bars 34 is in no way indicative of their cross sectional shape or configuration, and that the table frame rails 32 and the table cross bars 34 may have any cross sectional shape desired.

The number and size of the table cross bars 34 can be determined by one of ordinary skill in the art to give the table 22 adequate rigidity (i.e., prevent undesirable flexing of the table 22) and structural support when the table 22 is in use. For instance, the table frame 30 can include six table cross bars 34 for a long table and only two table cross bars 34 for a short table.

In the disclosed examples, the table frame 30 includes four table cross bars 34. The two outwardly positioned table cross bars 34, which are hereinafter referred to as outer cross bars 36, are rotationally and pivotally attached to the table frame rails 32. Each table support 26 is attached to one of the outer cross bars 36, thereby pivoting with respect to the table frame 30 when the table cross bars 36 rotate with respect to the table frame rails 32.

Figure 14:
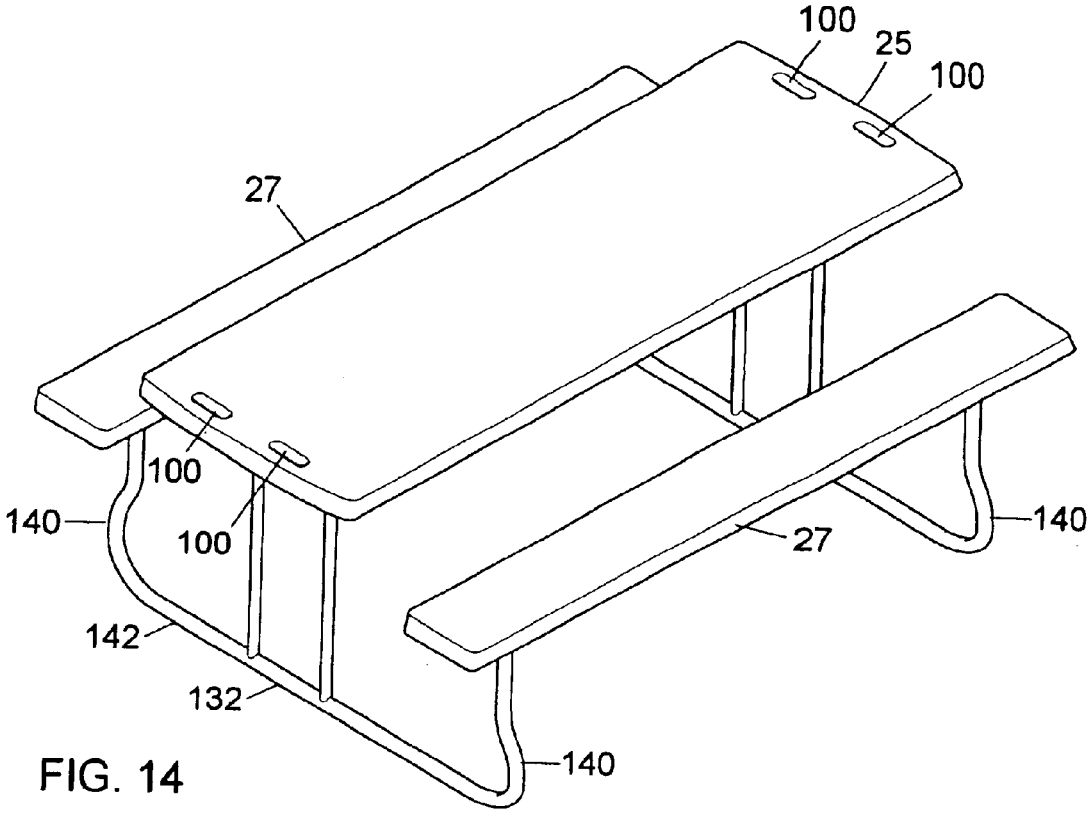
FIG. 14 is a perspective view of a picnic table constructed in accordance with the teachings of the second example of the instant invention.
Figure 15:
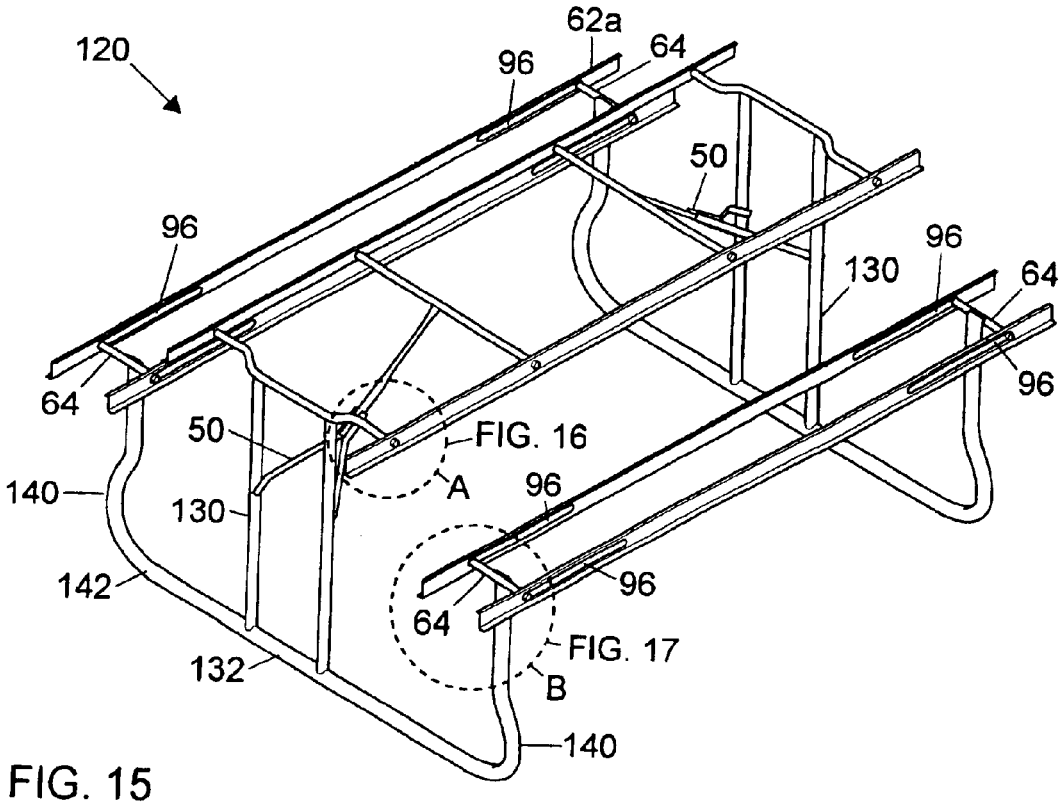
FIG. 15 is a perspective view of an undercarriage of the picnic table of FIG. 14.
Figure 16:
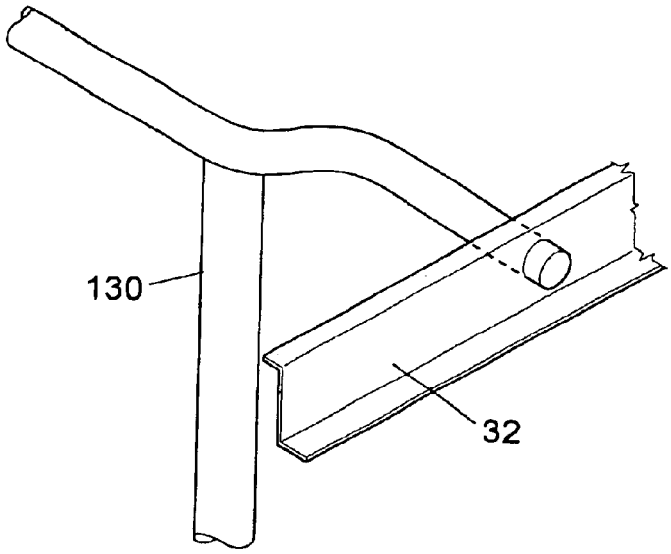
FIG. 16 is an enlarged view of area A of FIG. 15.
Figure 17:
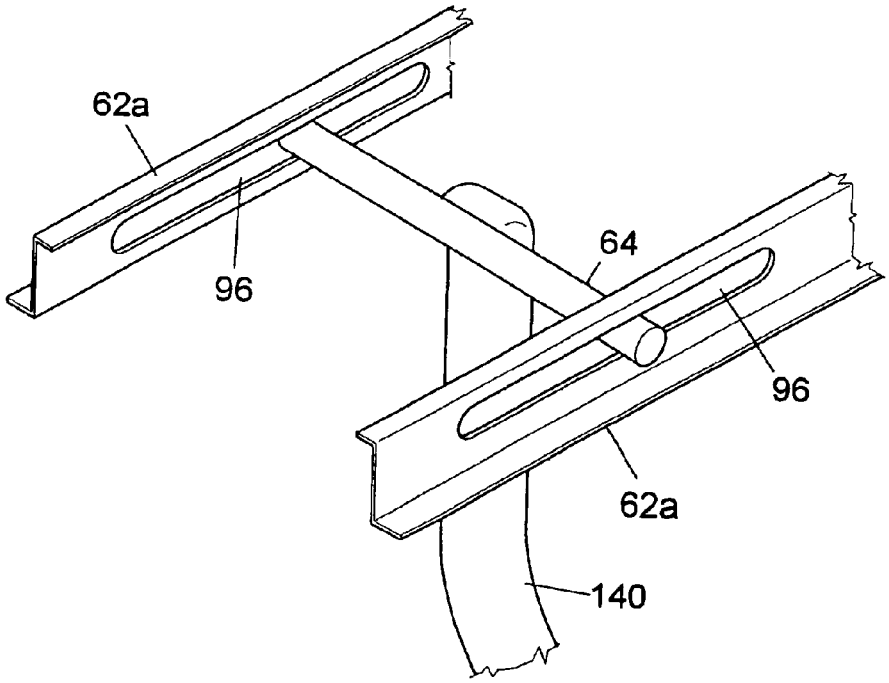
FIG. 17 is an enlarged view of area B of FIG. 15.

Each table support 26 includes two table legs 40 that are attached at one end to a corresponding outer cross bar 36 and that extend generally perpendicular therefrom, in this example. One of ordinary skill in the art will appreciate that each outer cross bar 36 can be either attached to its respective table support 26 or be integral with its respective table support 26. The lower portions of the table legs 40 are shaped to define table feet 41 that directionally diverge from each other in a direction perpendicular to the length of the table 22 where the table supports 26 contact the ground when in the setup configuration. In other words, the table supports 26 nearly resemble an upside down T-shape. Each table leg 40 can be joined together by one or more transverse support beams 42. Each table leg 40 can also have a laterally and outwardly directed bend relative to the table top 25 that transitions into a respective table foot 41, on which the table support 26 contacts the ground when the picnic table 20 is in the setup configuration. Alternatively, as shown in FIG. 14, the table legs 40 and the bench supports 28 can joined together by a one-piece support beam 43 that is co-linear and extends between the table feet 41. Furthermore, one of ordinary skill in the art will appreciate that each table support 26 can include only one leg or more than two legs. However, those of ordinary skill in the art will also appreciate that the table supports 26 resemble an upside down T-shape to provide for attachment of the benches 24 as will be described in detail below.

To secure the table supports 26 in the setup configuration, a pair of diagonal braces 50 (shown in FIGS. 12 and 13) connect the table supports 26 to beneath the table 22, at a point other than the pivot point of the table supports 26. One of ordinary skill in the art will appreciate that the diagonal braces 50 may be connected directly to the table top 25. However, in the disclosed examples, the diagonal braces 50 are pivotally connected to a corresponding interior table cross bar 34 (i.e., other than the outer cross bars 36). The pivotal connection of each diagonal brace 50 to a respective interior table cross bar 34 may be achieved with at hinge at the connection point. However, in the disclosed example, the interior table cross bars 34 are rotationally and pivotally attached to the table frame rails 32, and the each diagonal brace is fixedly connected to a respective interior table cross bar 34. Thus, rotation of the interior table cross bars 34 provide the pivoting movement of the respectively attached thereto diagonal braces 50. The diagonal braces 50 prevent the table supports 26 from pivoting when the picnic table 20 is in the setup configuration. Furthermore, the diagonal braces 50 provide structural support for the table 22.

Each diagonal brace 50 includes a forked or bifurcated portion 52 and a single support portion 54, which are pivotally connected together at a hinge or pivot 56. Each end of the forked portion 52 is pivotally attached to a respective leg 40 of a corresponding table support 26. The forked portion 52 and the single support portion 54 pivot about the hinge 56. To prevent such pivoting when the picnic table 20 is in the set up configuration, a slidable collar 58 (shown in FIGS. 12 and 13) can be disposed on the single support portion 54. When the picnic table 20 is in the setup configuration, the forked portion 52 and the single support portion 54 are aligned and lie in the same plane. To secure the table support 26 when the picnic table 20 is in the setup configuration, the collar 58 can be moved along the single support portion 54 until it bears against the forked portion 52, thereby resting over the hinge 56. The collar 58 prevents the hinge 56 from allowing the pivoting of the single support portion 54 relative to the forked portion 52, thereby preventing pivotal movement of the table support 26 relative to the table top 25. Furthermore, the collar 58 will remain over the hinge 56 when the picnic table 20 is in the setup configuration because of the diagonal downward orientation of the diagonal brace 50.

One of ordinary skill in the art will appreciate that a wide variety of methods can be used for securing the table supports 26 in the setup configuration. For instance, the table supports 26 can be oriented with respect to the table top 25 at an angle that is greater than 90° when picnic table is in the setup configuration. Such an angle will prevent the table supports 26 from pivoting inward beneath the table top 25 when the picnic table 20 is in the setup configuration.

Each bench 24 includes a bench top 27 and a pair of bench supports 28. Each bench 24 is detachably connectable to the table 22, and each bench support 28 is pivotally attached beneath its associated bench 24. One of ordinary skill in the art will appreciate that the table 22 can be used without or separate from the benches 24. Thus, the table 22 can be used as a stand alone table and not a picnic-type table. Alternatively, one of ordinary skill in the art will readily appreciate that both benches 24 need not be connected to the table 22 in the setup configuration. For instance, if the number of persons using the picnic table 22 is small enough to utilize only one bench, and if such persons desire to sit side-by-side on one bench, then the picnic table 24 can be setup by connecting only one bench 24 to one side of the table 22. However, such persons may desire to sit face-to-face, wherein both benches 24 can then be connected to the table 22 to provide face-to-face seating.

One of ordinary skill in the art will readily appreciate that the bench supports 28 can be pivotally attached to a corresponding bench top 27 by a wide variety of methods. For instance, each bench support 28 can be pivotally and directly attached to the bench top 27 with a hinge that provides pivotal movement of the bench support 28 beneath the bench top 27. However, each disclosed bench 24 includes a bench frame 60, to which the bench top 27 is attached and to which the pair of bench supports 28 are pivotally attached. Each bench frame 60 includes two spaced apart and generally parallel bench frame rails 62 connected together by a number of bench cross bars 64.

One of ordinary skill in the art will appreciate that the use of the words "rails" and "bars" to describe the bench frame rails 62 and the bench cross bars 64 is not indicative of their cross sectional shape or configuration, and that the bench frame rails 62 and the bench cross bars 64 may have any cross sectional shape desired.

In the disclosed example, each bench frame 60 includes two cross bars 64, which are rotationally or pivotally attached to the bench frame rails 62. Each bench support 26 is attached to a corresponding bench cross bar 64, thereby pivoting with respect to the bench frame 60 when the bench cross bars 64 rotate with respect to the bench frame rails 62.

Each bench support 28 includes a bench leg 65 that is attached at one end to a corresponding bench cross bar 64 and that extend generally perpendicular therefrom, in this example. One of ordinary skill in the art will appreciate that the bench cross bars 64 can be either attached to the respective bench support 28 or be integral with the respective bench support 28. The lower portion of each bench leg 65 is shaped to define a bench foot 67 that is generally parallel to each bench cross bar 64 and contacts the ground when in the picnic table 20 is the setup configuration.

To detachably connect the benches 24 to the table 22 when the picnic table 20 is in the setup configuration, each table foot 41 includes a table support end 70. Thus, a pair of table support ends 70 are directed outwardly on each side of the table 22 toward respective bench supports 28. Each bench foot 67 includes a bench support end 72 that is directed inwardly on a side of the corresponding bench 24 toward a respective table support end 70.

To detachably connect a bench 24 to the table 22, the bench support ends 72 are aligned with two corresponding table support ends 70 when the picnic table 20 is in the setup configuration. The table support ends 70 are then connected to the corresponding bench support ends 72. One of ordinary skill in the art will readily appreciate that any type of suitable and detachable connection can be adopted for the connection of the table support ends 70 with the bench support ends 72. However, in the disclosed example, the table support ends 70 and the bench support ends 72 are tube-like (i.e., hollow) and connect together by telescopic mating. In this example, the table support ends 70 are inserted into the corresponding bench support ends 72 for a connection of the benches 24 to the table 22.

One of ordinary skill in the art will readily appreciate that the bench support ends 72 can be secured or locked to the table support ends 70 by a wide variety of methods. However, in the disclosed example, each table support end 70 includes a pair of spring biased pins 71 that are biased outwardly. Each of the bench support ends 72 includes corresponding holes 74 that correspond in size to the diameter of the pin 71. In the process of mating a table support end 70 with a corresponding bench support end 72, the pins 71 retract until snapping through the respective holes 74 when the pins 71 and the holes 74 are aligned. The bench support ends 72 are thus securely but detachably held to the table support ends 70.

The bench support ends 72 and the table support ends 70 can be detached from each other by pressing the pins 71 inward to release them from the corresponding holes 74. The bench support ends 72 are simultaneously slid out of the table support ends 70. One of ordinary skill in the art will appreciate that alternatively, the bench support ends 72 may be inserted in the table support ends 70 for connecting the two together. Accordingly, the pins 71 would be disposed on the bench support ends 72 and the corresponding holes 74 would be on the table support ends 70.

Figure 23:
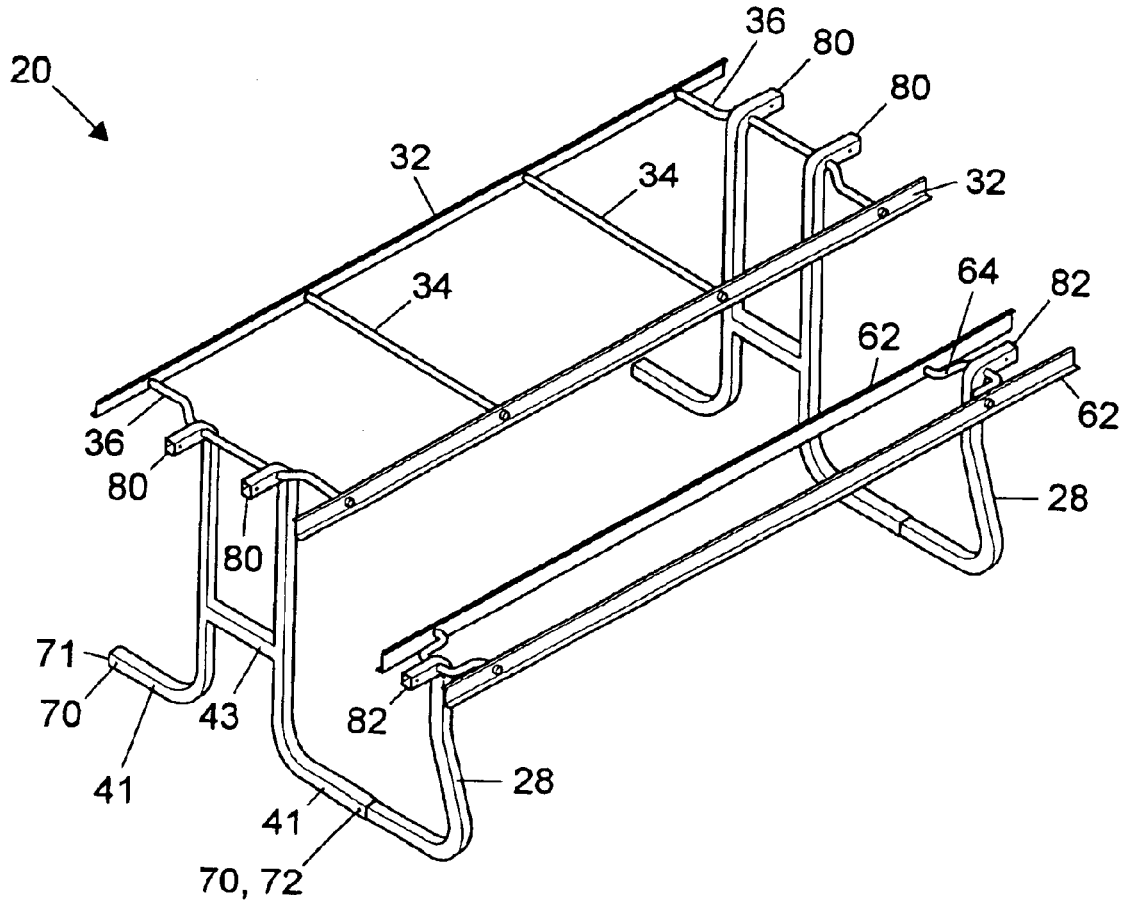
FIG. 23 is a perspective view of a picnic table constructed in accordance with an alternative teaching of the first example of the instant invention.

To detachably connect the benches 24 to the table 22 when the picnic table 20 is in the portable configuration, a pair of table connectors 80 are attached to each outer cross bar 36, and corresponding bench connectors 82 are attached to each respective bench cross bar 64. One of ordinary skill in the art will readily appreciate that the table connectors 80 and the bench connectors 82 may be extensions of the table supports 26 and the bench supports 28, respectively, as shown in FIG. 23. Alternatively, the table connectors 80 and the bench connectors 82 may be integral components of the outer cross bars 36 and the bench cross bars 64 (not shown), respectively. The disclosed table connectors 80 are attached to the outer cross bars 36 so as to be positioned nearly parallel with the table top 25 when the table supports 26 are in the setup configuration and nearly perpendicular with the table top 25 when the table supports 26 are in the portable configuration. Similarly, the bench connectors 82 are attached to the bench cross bars 64 so as to be positioned nearly parallel with the bench top 27 when the bench supports 28 are in the setup configuration and nearly perpendicular with the bench top 27 when the bench supports 28 are in the portable configuration.

When the picnic table 20 is in the portable configuration, the table connectors 80 detachably connect to the bench connectors 82 and can do so in a wide variety of methods. In the disclosed example, the table connectors 80 and the bench connectors 82 are tube-like (i.e., hollow) and connect together by telescopic mating similar to the telescopic mating of the table support ends 70 and the bench support ends 72. Accordingly, in this example, each table connector 80 includes a spring biased pin 81 that corresponds in size to holes 84 on the bench connectors 82. Thus, connecting and locking a table connector 80 to a bench connector 82, and releasing and disconnecting a table connector 80 from a bench connector 82, is similar to the method described in connecting with detachably connecting the table support ends 70 to the bench support ends 72.

Re-configuring the picnic table 20 between the setup configuration and the portable configuration for the first disclosed example will now be described. The table 22 is supported by table supports 26 when in the setup configuration as shown in FIG. 1. One of ordinary skill in the art will readily appreciate that the table supports 26 may be at any angle relative to the table top 25 as long as the table supports 26 provide adequate support for the table 22 when in use. However, in the disclosed example, the table supports 26 are near perpendicular to the table 22 when the picnic table 20 is in the setup configuration.

Each bench 24 and the weight of persons who may be sitting on the bench 24 are supported by the pair of bench supports 28 when the picnic table 20 is in the setup configuration. One of ordinary skill in the art will readily appreciate that the bench supports 28 may be at any angle relative to the bench 24 as long as the bench supports 28 provide adequate support for the bench 24 during use. However, in the disclosed example, the bench supports 28 are near perpendicular to their respective benches 24 when the picnic table 20 is in the setup configuration.

Figure 6:
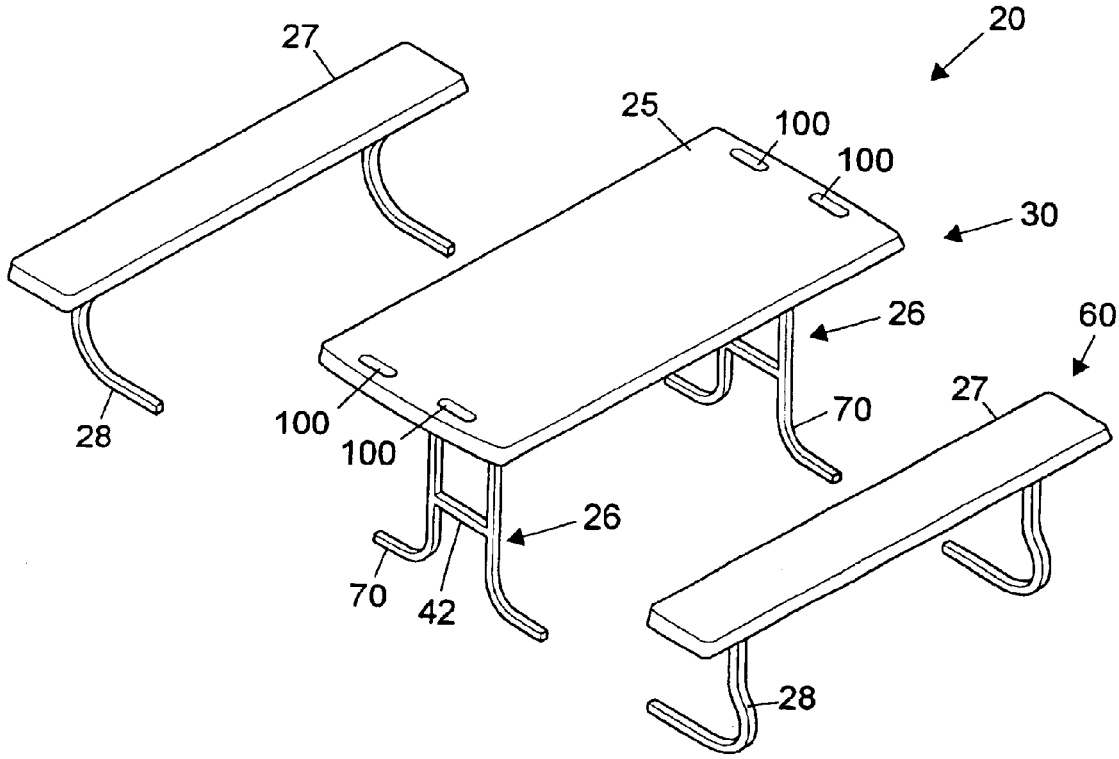
FIG. 6 is a perspective view of the picnic table of FIG. 1, shown with detached benches.
Figure 7:
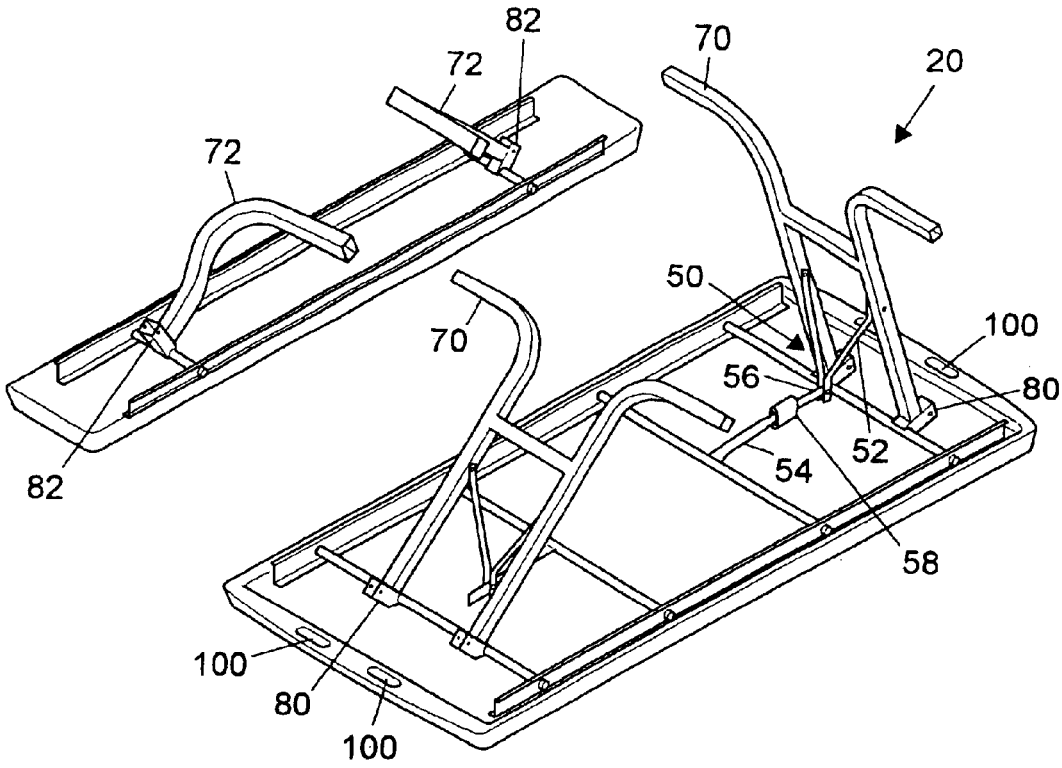
FIGS. 7–13 are various perspective views of a picnic table constructed in accordance with the teachings of the first example of the instant invention, and showing the picnic table in successive partially portable configurations.
Figure 8:
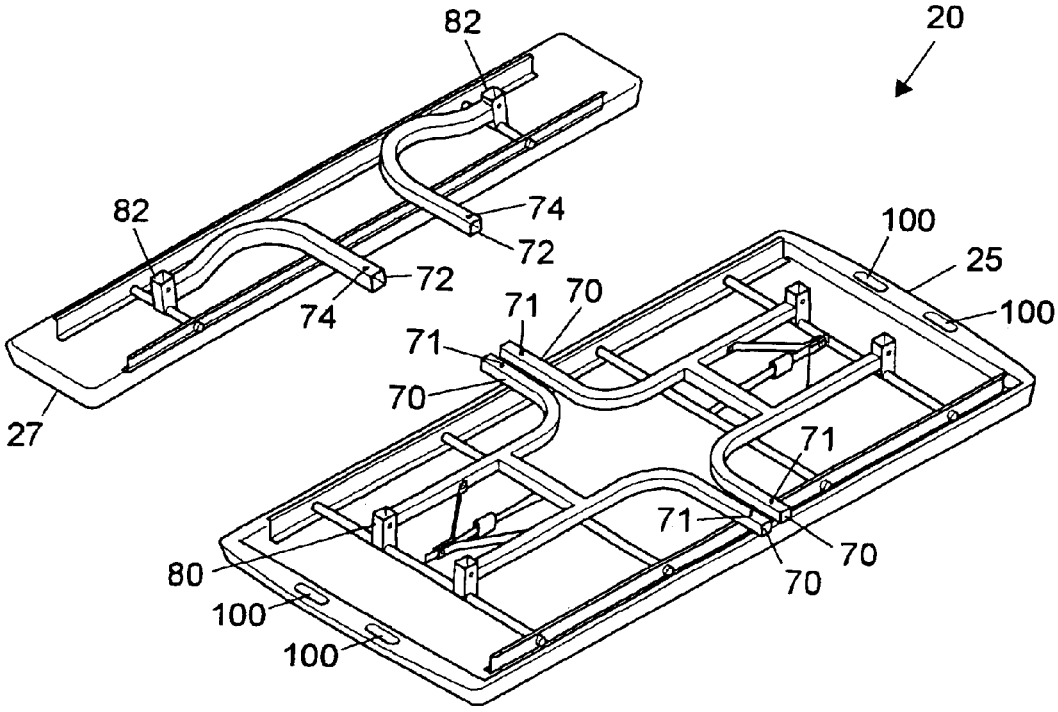

As shown in FIG. 6, the first step in configuring the picnic table 20 from the setup configuration to the portable configuration is to detach the benches 24 from the table 22 by disengaging the pins 71 from the holes 74. After detachment, the bench supports 28 are pivoted inward beneath their respective bench tops 27 until the bench supports 28 lie flat against the bench top 27, as shown successively in FIGS. 7 and 8. The table supports 26 are also pivoted inward beneath the table top 25 until the table supports 26 lie flat against the table top 25 and nearly parallel with the table top 25, also shown in FIG. 8. However, to pivot the table supports 26 inward, the hinge 56 of the diagonal brace 50, if utilized, should be allowed to freely pivot. To that end, the collar 58 is slid upwardly along the single support portion 54 until the collar 58 clears the hinge 56. Thereafter, pivoting of each table support 26 inward beneath the table top 25 causes the diagonal brace 50 to pivot at both ends of the diagonal brace 50, thereby collapsing the hinge 56. Thus, the diagonal brace 50 folds at the hinge 56 until it lies flat against the table top 25 along with its associated table support 26.

Figure 9:
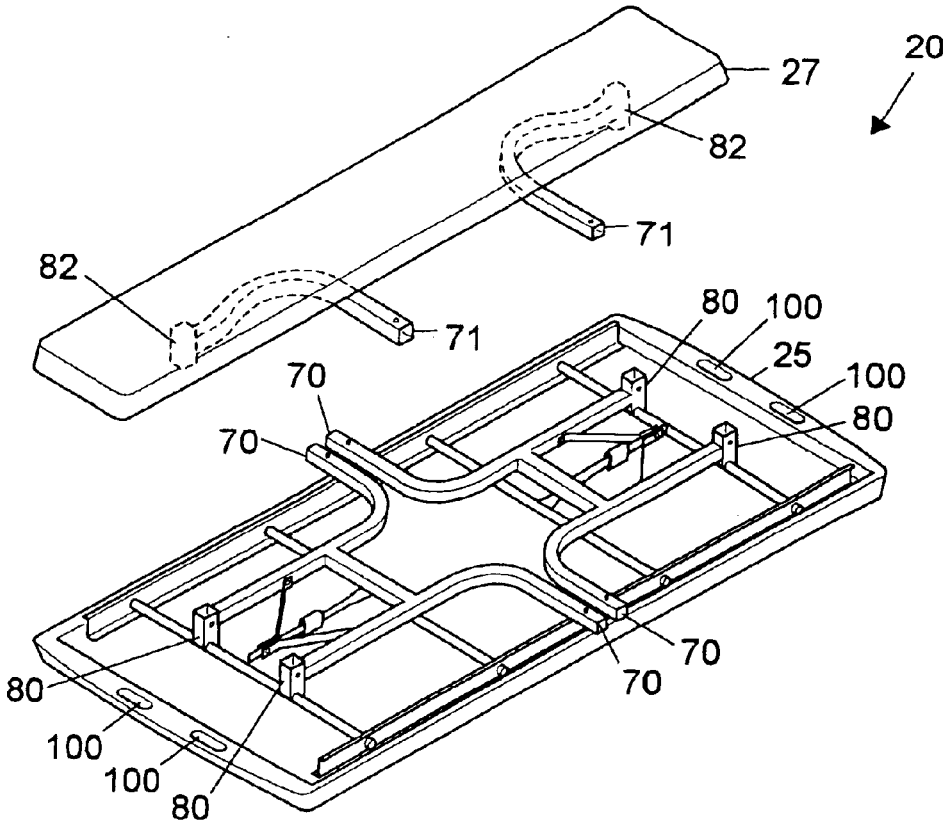
Figure 10:
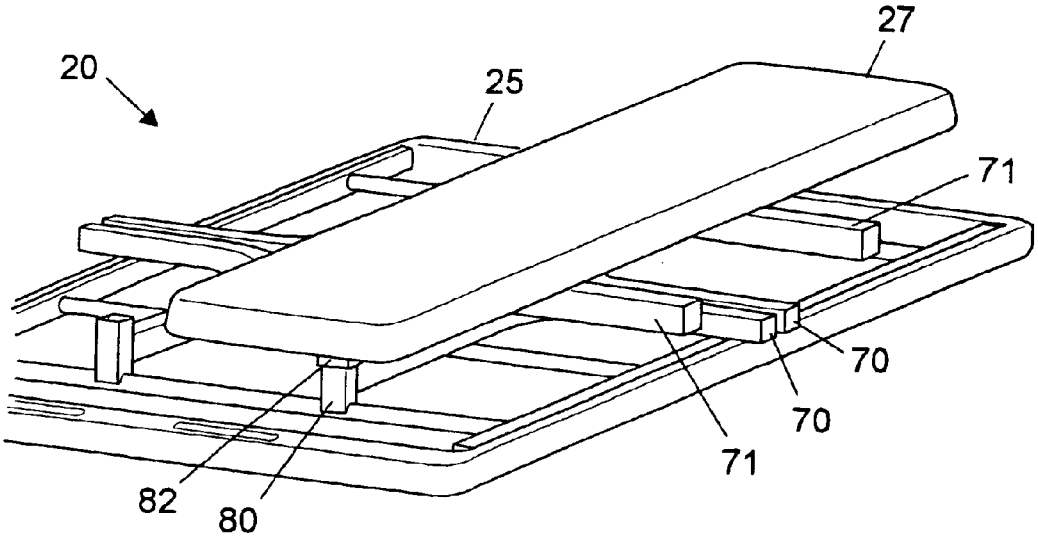
Figure 11:
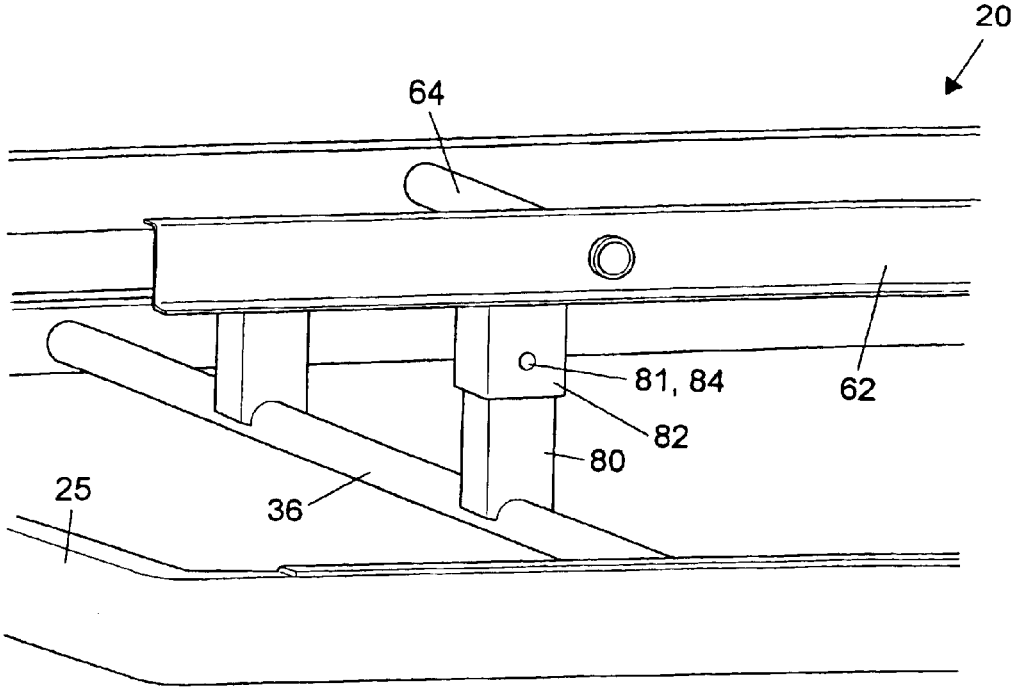
Figure 12:
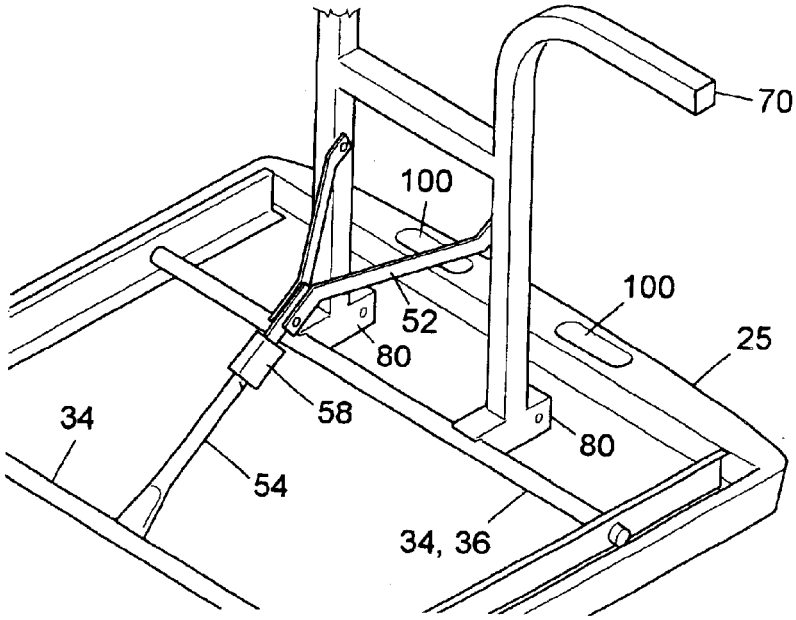
Figure 13:
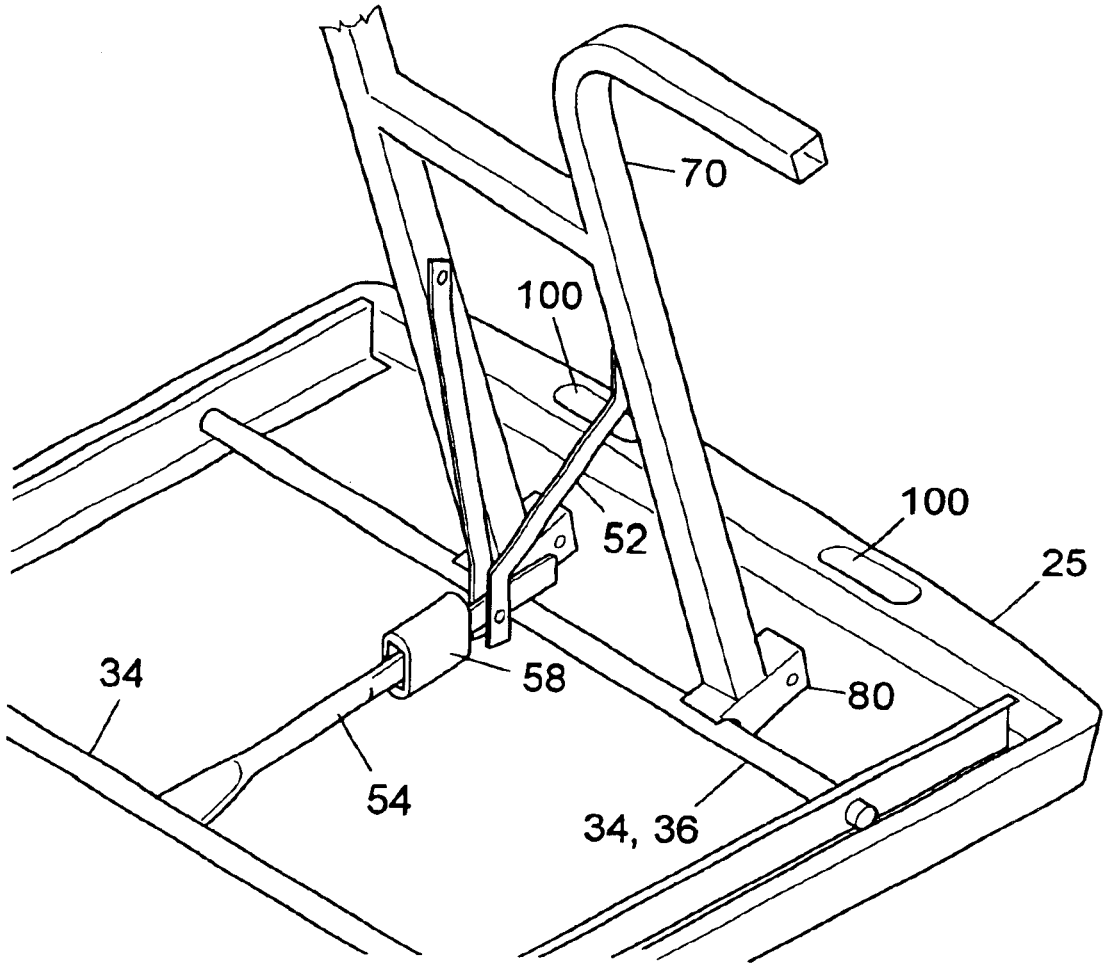

As shown in FIGS. 9 and 10, the benches 24 are then positioned so that each bench connector 82 of each bench 24 is aligned with a corresponding table connector 80 on the same lateral side of the table 22. The bench connectors 82 and the corresponding table connectors 80 are then connected together by the engagement of the pins 81 with the corresponding holes 84. As a result, the picnic table 20 in the portable configuration has the same width as the width of the table 22, which can easily fit in typical small trucks, minivans, sport utility vehicles, and other types of personal use automobiles.

To convert the picnic table 20 from the portable configuration to the setup configuration, the benches 24 are first detached from the table 22 by pressing the pins 81 on the table connectors 80 inward to release them, thereby allowing the benches 24 to be pulled away from the table 22. The table 22 is then placed in the setup configuration by pivoting the table supports 26 outward to nearly a perpendicular orientation relative to the table top 25, thereby unfolding the diagonal braces 50, if utilized. The collars 58 can then be slid over the hinges 56 of the diagonal braces 50. The benches 24 are placed in the setup configuration by pivoting each of the bench supports 28 outward away from the bench. The benches 24 are then connected to the table 22 by engaging pins 71 of the table support ends 70 with the holes 74 of the bench support ends 72.

Referring to FIGS. 14–19, a second example of a picnic table 120 constructed in accordance with the teachings of the invention is shown. The picnic table 120 is similar to picnic table 20 in many respects, thus, like reference numbers identify like parts. In the second example, the benches 24 are not detachable, but instead remain attached to the table 22. Each table support 26 includes one or more table legs 130 that are connected at their respective upper ends to the outer cross bar 36, and connected at their respective lower ends to a table foot 132 that is generally perpendicular to the table legs 130. The table foot 132 contacts the ground when the picnic table 120 is in the setup configuration.

Each bench support 28 includes a bench leg 140 that is attached at one end to a corresponding bench cross bar 64 and that extends generally perpendicular therefrom, in this example. The lower portion of each bench leg 140 is shaped to define a bench foot 142 that is generally parallel to each bench cross bar 64 and contacts the ground when in the picnic table 20 is the setup configuration. The bench foot 142 of each bench 24 is fixedly attached to a respective table foot 132 of each table support 26. Accordingly, each bench support 28 pivots simultaneously with a respective table support 26.

One of ordinary skill in the art will readily appreciate that the bench supports 28 can be pivotally and slidably attached to a corresponding bench top 27 by a wide variety of methods. However, in the second example, the bench frames 60 include bench frame rails 62*a* that have tracks 96, in which the ends of the cross bars 64 can both slide and rotate. Accordingly, each bench support 26 can slide and pivot with respect to the bench top 27 when the bench cross bars 64 slide and rotate with respect to the bench frame rails 62*a*.

Figure 18:
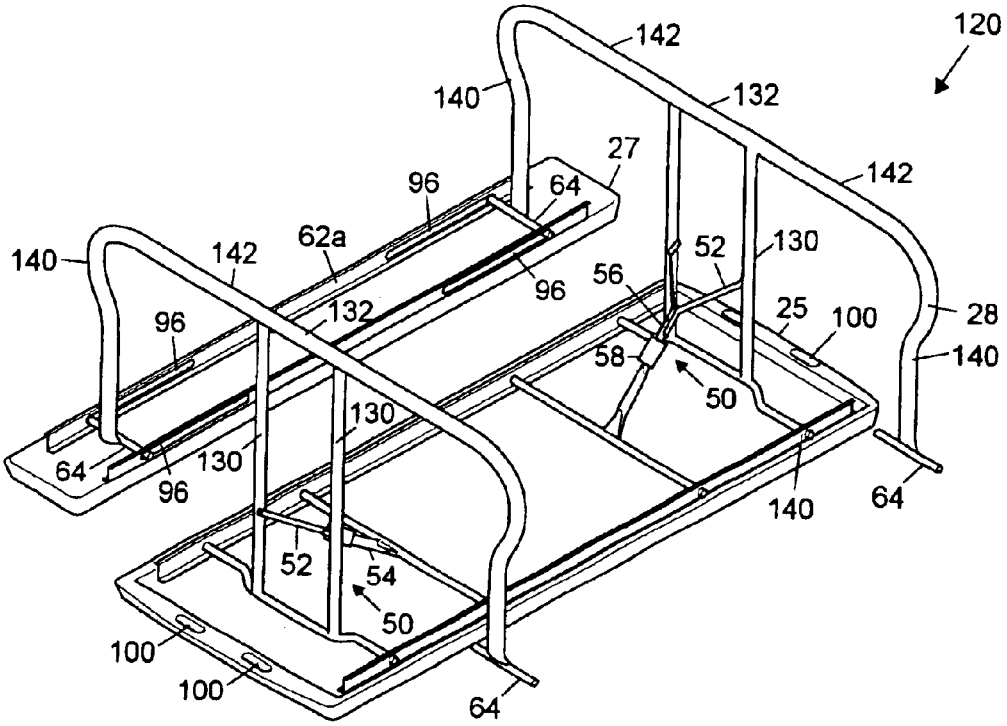
FIGS. 18 and 19 are perspective views of the picnic table of FIG. 14, shown in successive partially portable configurations.
Figure 19:
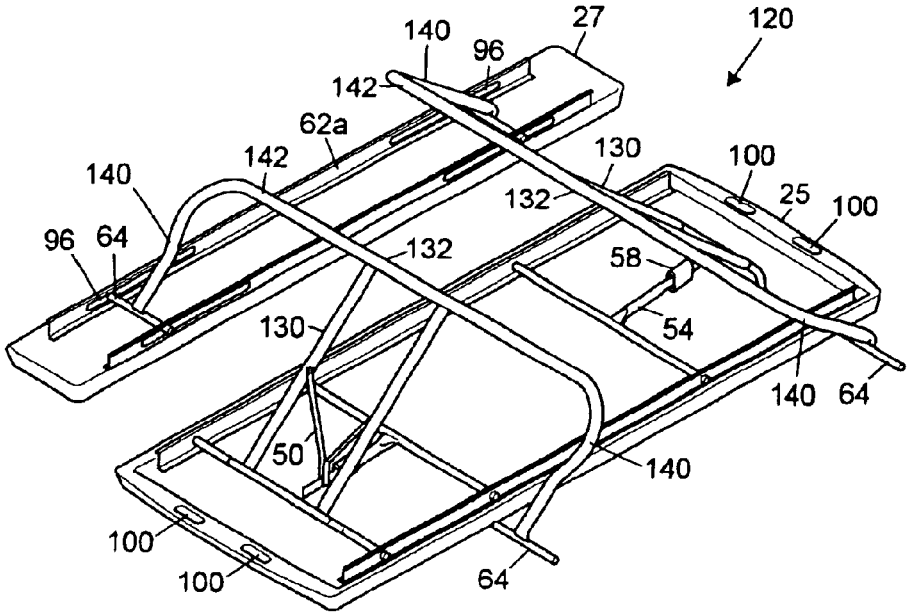

The picnic table 120 can be re-configured between the setup configuration and the portable configuration. As shown in FIGS. 18 and 19, to change from the setup configuration, the table supports 26 can be pivoted inward beneath the table 22, while simultaneously sliding the bench supports 28 inward toward one another and pivoting the bench and table supports 28, 26 inward beneath the table 22. Before the picnic table 120 can be configured from the setup configuration to the portable configuration, however, the diagonal brace 50, if present, must be folded beneath the table as described in detail in the foregoing. When the table 120 is in the portable configuration, the table 22 and the benches 24 lie flat in one plane. To re-configure the picnic table 20 from the portable configuration to the setup configuration, the table supports 26 are pivoted outward from beneath the table 22, while the bench supports 28 are simultaneously slid outward and pivoted outward. To complete the setup configuration, the diagonal brace 50, if present, is secured from folding by the collar 58 as described in detail in the foregoing.

Figure 20:
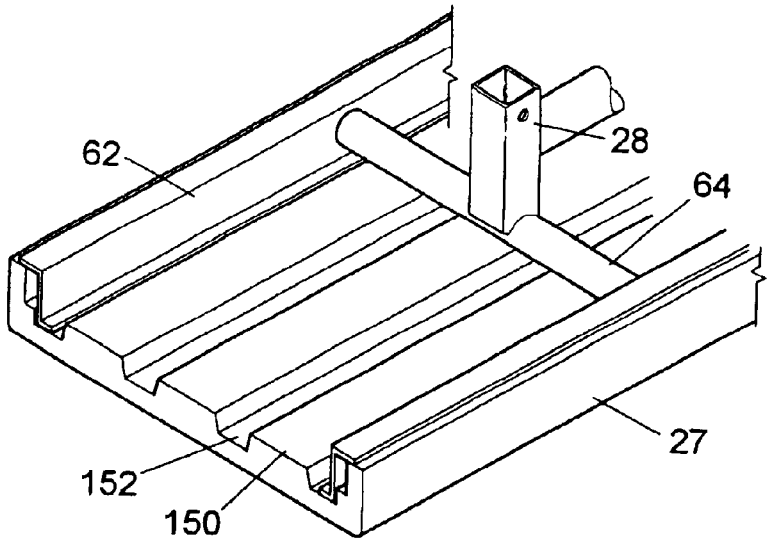
FIG. 20 is a perspective view of a bench constructed in accordance with the first example of the instant invention.
Figure 21:
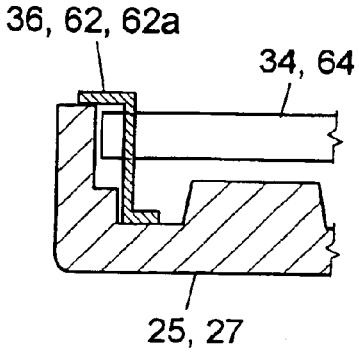
FIG. 21 is a cross sectional view of a picnic table constructed in accordance with the teachings of the first and second examples of the instant invention.
Figure 22:
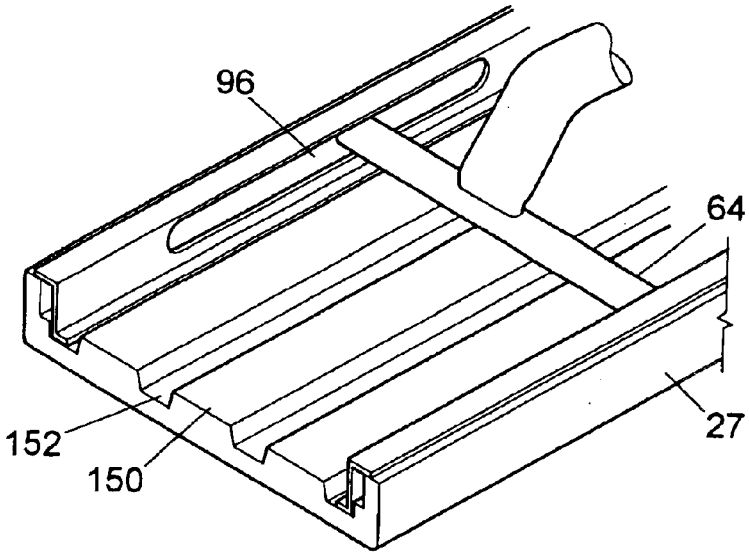
FIG. 22 is a perspective view of a bench constructed in accordance with the teachings of the second example of the instant invention.

The table top 25 and the bench tops 27 can be constructed from any material. In one example, the table top 25 and the bench tops 27 are constructed with a light weight material such as any type of applicable plastic, including polypropylene, polyethylene, polycarbonate, polystyrene, or suitable thermoplastic elastomers. One of ordinary skill in the art will appreciate that manufacturing the table top 25 and the bench tops 27 with a plastic material can be accomplished by many a wide variety of methods. For instance, the table top 25 and the bench tops 27 may be manufactured by extrusion, injection molding, or blow molding. Additionally, the table top 25 and the bench tops 27 may be constructed with a wide variety of cross sectional shapes to provide adequate rigidity and structural support during use. In one example, as shown in FIGS. 20–22, the table top 25 and the bench tops 27 can be constructed with a number of longitudinal hollow cells 150 that are connected together by hollow ridges 152. Referring to FIG. 21, the table support rails 36 can be either fastened to the table top 25, or being co-manufactured with the table top 25 so as to be embedded in the table top 25 (not shown). Also, as shown in FIG. 21, the table support rails 62, 62*a* can be either fastened to the bench tops 27, or be co-manufactured with the bench tops 27 so as to be embedded in the bench tops 27 (not shown).

Each table top also includes handles 100 that preferably are located on the table top 100 for providing even load distribution when carrying the picnic table 20 when in the setup or portable configuration. As shown in FIG. 20, the bench cross bars 64 are rotationally attached to the bench frame rails 62 in the first example. As shown in FIG. 22, the bench cross bars 64 are slidably and rotationally attached to the bench frame rails 62*a* in the tracks 94 in the second example.

Although certain apparatuses constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A portable picnic table reconfigurable between a portable configuration and a setup configuration, the picnic table comprising:

a table having a pair of table supports pivotally attached beneath the table, each table support including a pair of table support ends;

a pair of benches, each bench having a pair of bench supports pivotally attached beneath the bench, each bench support including a bench support end;

a pair of bench connectors pivotally attached beneath each bench; and a plurality of table connectors pivotally attached beneath the table;

wherein the bench support ends are detachably attachable to the table support ends when the picnic table is in the setup configuration, and the bench connectors are detachably attachable to the table connectors when the picnic table is in the portable configuration.

2. A portable picnic table according to claim 1, wherein the benches are parallel to and adjacent the table.

3. A portable picnic table according to claim 1, the table including a pair of diagonal braces pivotally connecting the table supports to beneath the table, wherein the diagonal braces are adapted to prevent the picnic table from being configured to the portable configuration when the picnic table is in the setup configuration.

4. A portable picnic table according to claim 1, the table including a table frame and a table top, wherein the table supports and the table connectors are pivotally attached to the table frame.

5. A portable picnic table according to claim 1, the table connectors being substantially perpendicular to the table in the portable configuration, and the bench connectors of each bench being substantially perpendicular to the bench in the portable configuration, wherein each bench connector of each bench is adapted to engage a corresponding table connector of the table in the portable configuration.

6. A portable picnic table according to claim 1, the table supports adapted to pivot between a setup configuration and a portable configuration, the table supports being substantially perpendicular to the table in the setup configuration, and the table supports being substantially parallel with the table in the portable configuration.

7. A portable picnic table according to claim 1, the bench supports adapted to pivot between a setup configuration and a portable configuration, each bench support being substantially perpendicular to the bench in the setup configuration, and each bench support being substantially parallel to the bench in the portable configuration.

8. A portable picnic table according to claim 1, each bench including a bench frame and a bench top, wherein the bench supports and the bench connectors are pivotally attached to the bench frame.

9. A portable picnic table configurable between a portable configuration and a setup configuration comprising:

a table including a table frame and a table top attached to the table frame, the table frame having a pair of longitudinally spanning table support rails spaced apart by a plurality of laterally spanning table cross bars, wherein the plurality of cross bars include at least a pair of cross bars outwardly opposed relative to a center of the table;

a pair of table supports, each table support attached to each of the outwardly opposed cross bars, wherein each table support is adapted to be pivotable relative to the table frame, each table support including a pair of table support ends;

two pairs of table connectors, each pair of table connectors connected to each of the outwardly opposed cross bars, wherein each table connector is adapted to be pivotable relative to the table frame;

a pair of benches, each including a bench frame and a bench top attached to the bench frame, each bench frame having a pair of longitudinally spanning bench support rails spaced apart by a pair of laterally spanning bench cross bars;

a pair of bench supports associated with each bench, each bench support attached to a bench cross bar, wherein each bench support is adapted to be pivotable relative to the bench frame, each bench support including a bench support end;

a pair of bench connectors, each bench connector connected to a bench cross bar, wherein each bench connector is adapted to be pivotable relative to the bench frame;

wherein the bench support ends are detachably attachable to the table support ends when the picnic table is in the setup configuration, and the bench connectors are detachably attachable to the table connectors when the picnic table is in the portable configuration.

10. A portable picnic table according to claim 9, wherein the table connectors are coupled to the outwardly opposed table cross bars.

11. A portable picnic table according to claim 9, wherein the bench connectors are coupled to the bench cross bars.

12. A portable picnic table according to claim 9, wherein the outwardly opposed table cross bars are pivotally attached to the table frame rails and the table supports are fixedly attached to the outwardly opposed cross bars.

13. A portable picnic table according to claim 9, wherein the bench cross bars are pivotally attached to the bench frame rails and the bench supports are fixedly attached to the bench cross bars.

14. A portable picnic table according to claim 9, comprising a pair of diagonal braces pivotally connecting the table supports to a pair of cross bars inwardly opposed relative to the center of the table, wherein the diagonal braces are pivotable relative to an associated table support and pivotable relative to the table frame, and wherein the diagonal braces are adapted to prevent the picnic table from being configured to the portable configuration when the picnic table is in the setup configuration.

15. A portable picnic table according to claim 14, wherein the inwardly opposed cross bars are pivotably attached to the table frame rails, and the diagonal braces are fixedly attached to the inwardly opposed cross bars.

16. A method of reconfiguring a portable picnic table between a portable configuration and a setup configuration, the method comprising the steps of:

a) providing a table having a pair of table supports pivotally attached beneath the table, each table support including a pair of table support ends, a pair of benches, each bench having a pair of bench supports pivotally attached beneath the bench, each bench support including a bench support end, a pair of bench connectors pivotally attached beneath each bench, and a plurality of table connectors pivotally attached beneath the table, b) detaching the bench connectors from the table connectors;

c) pivoting the table supports from a substantially parallel configuration relative to the table to a substantially perpendicular configuration relative to the table;

d) pivoting the bench supports from a substantially parallel configuration relative to a respective bench to a substantially perpendicular configuration relative to the bench; and e) attaching each bench support end to a corresponding table support end.

17. A method according to claim 16, wherein configuring the picnic table from the setup configuration to the portable configuration comprises the steps of:

a) detaching the table support ends from the bench support ends;

b) pivoting the bench supports from a substantially perpendicular configuration relative to a respective bench to a substantially parallel configuration relative to the bench;

c) pivoting the table supports from a substantially perpendicular configuration relative to the table to a substantially parallel configuration relative to the table; and d) attaching each bench connector to an associated table connector.

* * * * *